United States Patent [19]

Weem

[11] Patent Number: 4,724,884

[45] Date of Patent: Feb. 16, 1988

[54] FOLDING WALL

[76] Inventor: Petrus J. P. Weem, J. Boschstraat 6, Oosterhout, 4907 MR, Netherlands

[21] Appl. No.: 869,727

[22] Filed: Jun. 2, 1986

Related U.S. Application Data

[60] Division of Ser. No. 665,080, Oct. 26, 1984, Pat. No. 4,598,751, and a continuation of Ser. No. 542,091, Oct. 17, 1983, abandoned, and a continuation of Ser. No. 328,584, Dec. 4, 1981, abandoned.

[30] Foreign Application Priority Data

Apr. 15, 1980 [NL] Netherlands ..... 8002187

[51] Int. Cl.[4] ..... E06B 3/94

[52] U.S. Cl. ..... 160/84 R

[58] Field of Search ..... 160/84 R

[56] References Cited

U.S. PATENT DOCUMENTS

| | | | |
|---|---|---|---|
| 3,029,867 | 4/1962 | Mauer | 160/84 R |
| 3,850,223 | 11/1974 | Tompkins | 160/84 R |
| 3,979,861 | 9/1976 | Fromme et al. | 160/199 X |
| 4,027,714 | 6/1977 | Dixon et al. | 160/84 R |
| 4,142,931 | 3/1979 | Viol et al. | 160/84 R |
| 4,199,018 | 4/1980 | Hirschel et al. | 160/84 R |
| 4,598,751 | 7/1986 | Pieter-Weem | 160/84 R |

FOREIGN PATENT DOCUMENTS

| | | | |
|---|---|---|---|
| 275767 | 2/1965 | Australia | 160/84 R |
| 2506469 | 8/1975 | Fed. Rep. of Germany | 160/84 R |

*Primary Examiner*—Robert W. Gibson, Jr.
*Attorney, Agent, or Firm*—John P. Snyder

[57] ABSTRACT

A zigzag folding wall formed of a plurality of similar modules each of which includes first and second coupling members having two pairs of panels pivotally connected thereto so as to be folded in a zigzag fashion. A pair of bolts secure a coupling member of each of the modules to a coupling member of an adjacent module. The coupling members are provided with aligned holes formed therein for receiving a tool therethrough to engage the bolts when assembling or disassembling the wall.

9 Claims, 5 Drawing Figures

FOLDING WALL

This application is a division of application Ser. No. 665,080, filed Nov. 26, 1984, now U.S. Pat. No. 4,598,751, which is a continuation of Ser. No. 542,091, Oct. 17, 1983, abandoned, which is a continuation of Ser. No. 328,584, filed as PCT NL81/00011, on Apr. 14, 1981, published as WO81/03043, on Oct. 29, 1981, abandoned.

SUMMARY OF THE INVENTION

The invention relates to a folding wall mainly comprising a double row of panels foldable in zigzag fashion by means of hinges.

The invention has for its object to improve the folding wall in a manner such that in the stretched state the panels lie in coplanar positions with the aid of simple means which, at the same time, facilitate folding of the wall. The invention has furthermore for its object to provide a folding wall which reduces transport and mounting costs by its modular structure.

The folding wall according to the invention is distinguished in that at least two panels being in opposite positions in the rows are pivotally interconnected by a coupling piece having two relatively spaced supporting members, while two blades of resilient material slidable between two supporting members are each fastened to an inner side of a panel.

Owing to the resilient blades the panels connected with said blades will be subjected to an inwardly directed force when the wall is drawn out, so that these panels can be moved into parallel positions. By means of the pivotal connection with the further panels, the latter will follow said movement, and move to the same plane.

According to the invention opening of the folding wall is facilitated because a lever is connected at a distance from the supporting members by means of a hinge with the coupling piece. By actuating said lever, which exerts pressure on the free ends of the resilient blades, an outwardly directed force is exerted on the associated panels so that the zigzag folding of the wall is facilitated.

The proximal sides of the spring blades are preferably coated with a layer of rough material to avoid slip between the spring blades and to ensure uniform flattening of the panels.

According to the invention the folding wall of the kind set forth in the preamble is furthermore characterized in that every four panels and two head strips being provided with means for fastening the strips to one another. Thus the mounting operation is drastically simplified, since every module is suspended to the guide rail required for the wall, after which only one operator need fasten the modules to one another. Since the modules are easily manipulated transport is simplified.

The coupling piece mentioned above is preferably formed by a head strip of a module.

In order to reduce the friction of the spring blades along the supporting members, the latter are formed by rollers arranged, in the modular structure of the wall, in two opposite sides of an opening in the head strips.

A simple construction and an effective sound-proof assembly are obtained in that, the panels and head strips are interconnected at the longitudinal edges by uninterrupted hinge profiles of synthetic resin.

BRIEF DESCRIPTION OF THE DRAWINGS

The invention will be described more fully with references to an embodiment. The accompanying drawing shows in.

DETAILED DESCRIPTION

Figure 1:
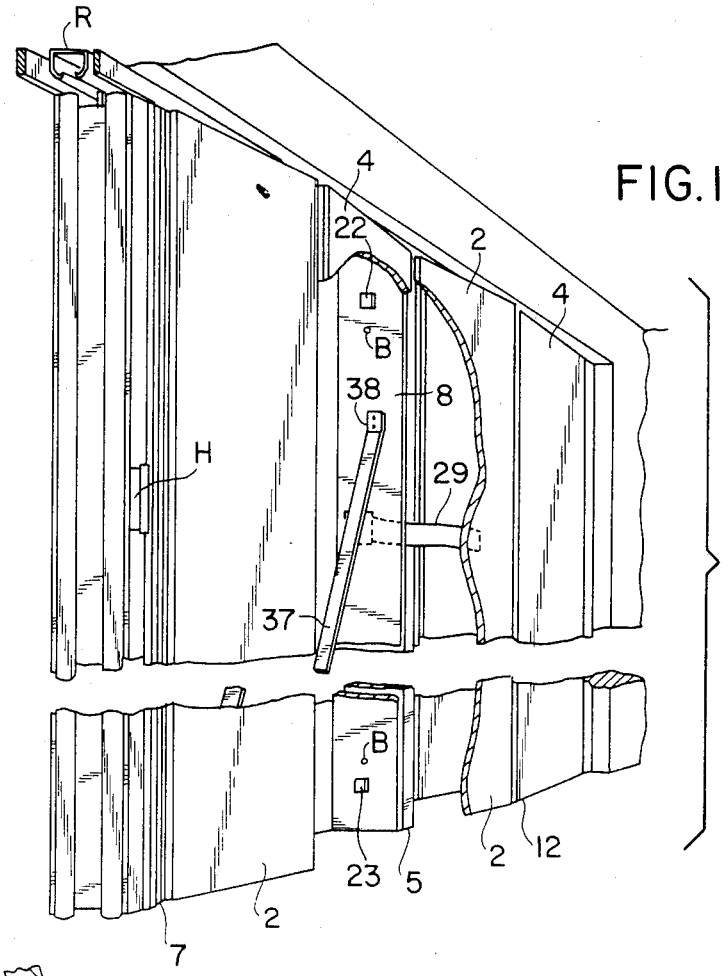
FIG. 1: a perspective view of part of the 30 folding wall in accordance with the invention.

The folding wall shown in the Figures is suspended from the overhead rail R and is composed of a plurality of modules each consisting of two pairs of relatively pivotable panels. Thus, as shown in Figure 3, one pair of panels for each module is designated by the reference characters 1 and 2 whereas the other pair of panels for each module is designated as 3 and 4. The panels 1 and 2 are pivotally connected by respective hinge means 6 and 7 to the opposite side edges of coupling means comprising the head strip or coupling member 5 whereas the panels 3 and 4 are pivotally connected to the opposite side edges of the coupling means 8 by respective hinge means 9 and 10. The two panels 1 and 3 and the two panels 2 and 4 of each module are likewise pivotally connected at their adjacent side edges by the hinge means 11 and 12. All of these hinge means are in the form of strips of synthetic resin material (see particularly FIG. 2). This structure relates to one module 13 as shown in FIG. 3 and the remainder of the modules 14–17 shown are of the same configuration, and for this reason, the same reference characters are employed in each module throughout the drawings to designate like components. Each module is suspended by a runner system fastened to the top side of each coupling member from the overhead rail R which extends along the top edge of a passage between two rooms.

Figure 5:
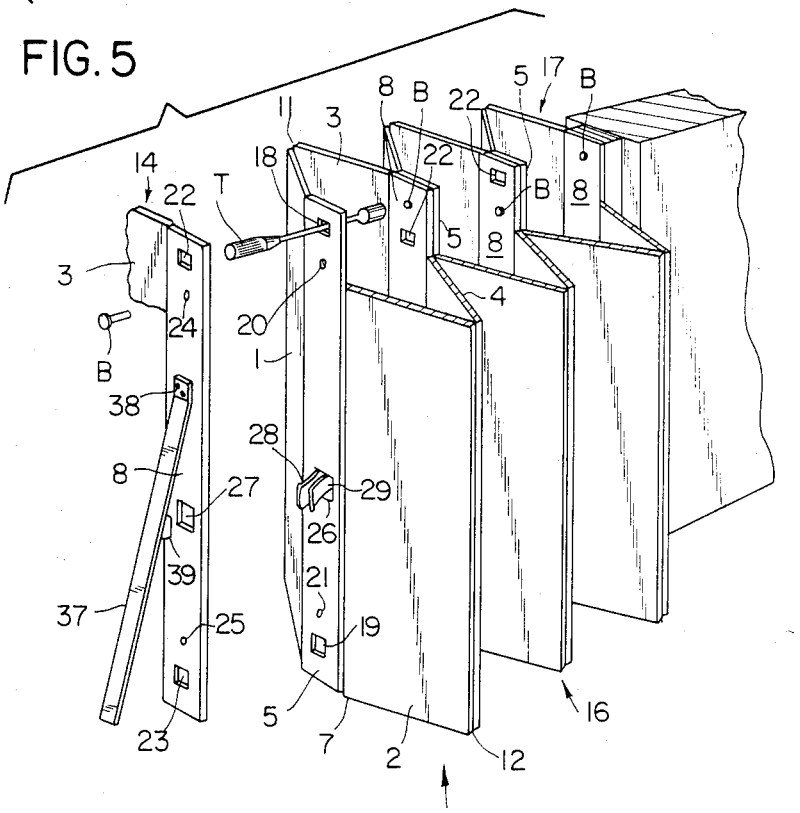

FIG. 5 illustrates the manner in which the modules are interconnected. As shown, each of the coupling members 5 is provided with a pair of rectangular openings 18 and 19 through which a tool T may be projected to reach to the associated coupling member 8 of that module. Likewise, each of the coupling members 5 is provided with a pair of tapped openings 20 and 21. The coupling member 8 for each module, on the other hand, is provided with a pair of rectangular openings 22 and 23 which register with the rectangular openings 18 and 19 of the associated coupling member 5 of the adjacent module with which it is in face-to-face contact and is also provided with openings 24 and 25 in register with the tapped openings 20 and 21 in such associated coupling member 5 so as to receive bolts B threaded in the respective tapped openings 20 and 21 to secure the associated coupling members 5 and 8 of the adjacent modules in face-to-face contact as shown.

The coupling members 5 and 8 are also provided with registering openings 26 and 27 (see also FIG. 2) through which the free end portions of a pair of blade springs or spring strips 28 and 29 are received. As is seen best in FIG. 2, the opposite ends of these spring strips are secured at 30 and 31 to the inner faces of the respective panels 1 and 2. The spring blades 28 and 29 are provided on their proximal sides with a coating of rough material 32, which may have a ridge profile, in order to avoid slip between the spring blades. Each coupling member 5 in provided with a pair of rollers 33 and 34 within its opening 26, the rollers defining a gap which allows the spring strips to engage at a contact point or region A. The sprng blades are provided near the free ends thereof with the ears 35 and 36 which prevent the free ends of the strips from escaping from between the rollers when the modules are in collapsed condition.

It will be noted that a lever 37 is hinged at one end as at 38 to the inner face of each coupling member 8 through which a pair of spring strips 28 and 29 project. This lever extends diagonally downwardly as seen best in FIGS. 1, 4 and 5 to the inner face of the coupling member 5 of that module when such module is expanded as shown in these Figures. Between its ends and in alignment with the openings 26 and 27, each such lever is provided with a bumper or pressing head 39 which is adapted to press against the free ends of the spring strips of an adjacent module. It will be noted that when the modules are in the collapsed condition, the two coupling members 5 and 8 of each module are closely spaced and will retain the pressing head 39 of the associated lever 37 against the free ends of the spring strips 28 and 29 of the adjacent module. It should also be noted that the leading module (i.e., the module 13 of FIG. 4) does not have spring strips 28 and 29 associated with it. Therefore, the only structure which is operating to hold this particular module in expanded condition is its associated lever 37 and the ends of the spring strips 28 and 29 of the adjacent module 14 bearing against the pressing head 39 of such lever. It should further be noted that the trailing module such as the module 17 in FIG. 5 does not require a lever 37 although it has the spring strips 28 and 29 to control such module.

Figure 2:
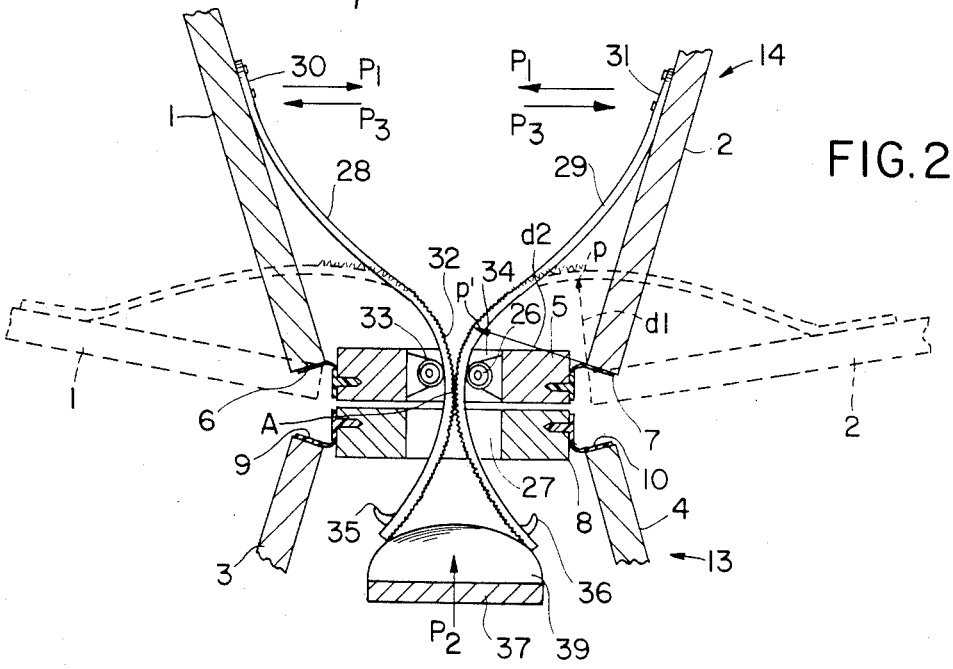
FIG. 2: an enlarged sectional detail of the wall of FIG. 1, FIG. 3: a horizontal sectional view of part of the folding wall in the stretched position.
Figure 3:
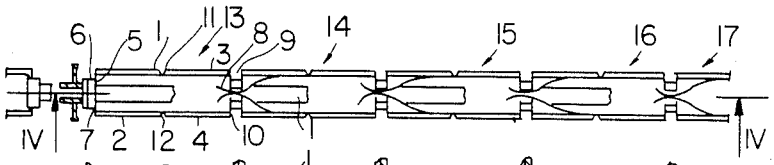
Figure 4:
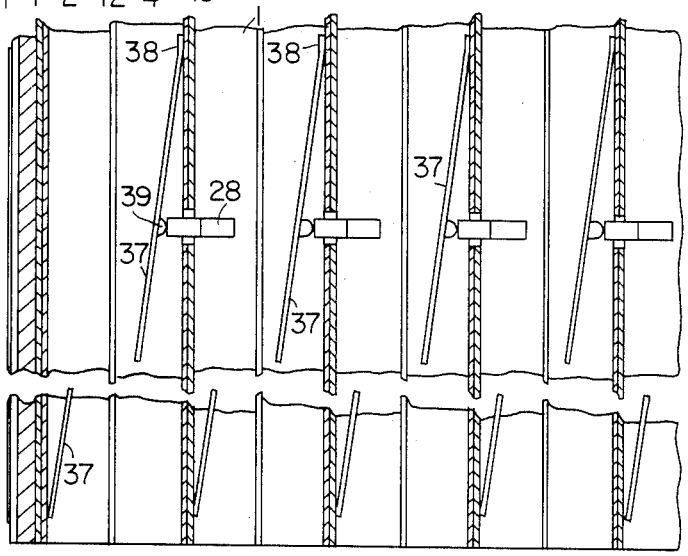
FIG. 4: a vertical sectional view of the folding wall of FIG. 3, FIG. 5: a perspective view of part of the folding wall illustrating the mounting operation.

The folding wall of the invention can be actuated from a collapsed condition of the modules to an expanded condition of the modules by pulling on the handle H, see FIGS. 1 and 3. In the collapsed condition, the panels 1 and 2 of a module are in generally coplanar relation, as are the panels 3 and 4. Thus, the inner faces of the panels 1 and 3 are in closely spaced, face-to-face opposition whereas the inner faces of the panels 2 and 4 are likewise so positioned. In the expanded condition, the panels 2 and 3 of a module are generally coplanar, as are the panels 2 and 4. The expanded condition of the modules is shown in FIGS. 1, 3 and 4. The panels 1 and 2 as shown in dashed lines in FIG. 2 are near their positions in which the module is in collapsed condition whereas the solid line positions of these panels are near the expanded condition of the module.

FIG. 2 illustrates the geometry which leads to realization of the invention. One necessary condition is that the spring strips be compelled to move past the rollers as the panels are swung. That is, as a natural consequence of the attachment point 30 of the spring strip 28 to the inner face of the panel 1 swinging about the center of arc defined by the hinge means 7, and the fact that the rollers 33 and 34 are between these hinge axes to define a gap receiving and guiding the movements of the spring strips, the spring strips 28 and 29 are compelled to move longitudinally back and forth between the rollers when the panels 1 and 2 fold relative to each other. The other necessary condition is that those portions of the spring strips which move past the rollers as aforesaid must have a shape which is flattened in the direction away from the rollers so as to converge to the contact point A. As a consequence, at an intermediate position of the panels as they are being inwardly swung, sufficient deformation of the spring blades has occurred and the contact point A between the spring blades has moved away from the rollers sufficient to exert forces on the panels urging them to the full inwardly swung positions.

The first necessary condition is evident from FIG. 2, as explained above. The shaping of the spring strips is also evident from FIG. 2. Thus, a shown in FIG. 2, the distance d1 from the axis of the hinge means 7 perpendicular to the face of the panel 2 to the point P on the associated spring blade 29 when the panel is in the dashed line position is smaller than the distance d2 from the axis of the hinge means 7 perpendicular to the face of the panel 2 to the point P' when the panel is in the full line position. Since the dashed line position of the panels 1 and 2 corresponds to that condition where the module is nearly fully collapsed whereas the full line position of the panels corresponds to the module approaching the expanded or inwardly swung position of the panels, it is evident that the aforesaid shaping of the spring blades 28 and 29 has caused them to be deformed as the panels 1 and 2 are swung from the dashed line position toward the full line position. It is also evident from FIG. 2 that the result of such shaping is that in both the dashed line position and the full line position of the panels, the two spring blades 28 and 29 are convergent from the rollers to the contact point A.

Thus, by drawing the folding wall from collapsed condition of the modules thereof toward expanded condition as by pulling on the handle H, the panels 1 and 2 and the panels 3 and 4 fold towards one another. Owing to these movements of the panels the spring strips are compelled to shift relative to the rollers as aforesaid so that they are deformed. The contact point A will shift away from the rollers, as controlled by the shape of the spring strips, so that in a semistretched or semiexpanded condition, the deformations cause inwardly directed forces to be exerted at the attachment points 30 and 31 in the direction of the arrows P1. These forces cause the modules to move to their expanded conditions.

In folding the wall to the collapsed condition of its modules, the levers 37 will be forced by the coupling members 5 to exert pressure by means of the pressing heads 39 on the free ends of the spring strips. This forces the spring strips to move in the direction P2 (forcing the contact point A toward the rollers) and acts through the attachments points 30 and 31 to produce the outwardly directed forces P3 so that the panels 1 and 2 are urged outwardly. As soon as the contact point A is forced to the side of attachment points 30 and 31 with respect to the rollers, a spring force generated in the spring strips by deformation will further the spread of the panels.

The invention is not limited to the embodiment described above. The flattening stretching by means of the resilient blades 28 and 29 may as well be used in another construction than that having the above-described module structure.

What is claimed is:

1. In a zigzag folding wall construction adapted to be constructed of a sequence of similar modules, a module comprising a pair of spaced coupling members adapted to be moved between a closely spaced condition and a widely spaced condition, a first pair of panels having first side edges pivotally connected with the respective coupling members and having second side edges pivotally connected together whereby said panels are substantially coplanar when said coupling members are in said widely spaced condition and are in face-to-face substantially parallel relation when said coupling members are in said closely spaced condition, a second pair of panels having first side edges pivotally connected with the respective coupling members and having second side edges pivotally connected together whereby said second pair of panels are substantially coplanar and are in spaced, parallel relation to said first pair of panels when said coupling members are in said widely spaced condition and are in face-to-face substantially parallel relation when said coupling members are in said closely spaced condition, at least one of said coupling members being adapted to be disposed in face-to-face relation to a coupling member of an adjacent module for forming a sequence of modules defining a door, and fastening means for removably fastening coupling members of adjacent modules in face-to-face relation.

2. In a zigzag folding wall construction as defined in claim 1 including a second module having a coupling member in face-to-face relation to said one coupling member of the module first mentioned.

3. In a zigzag folding wall construction as defined in claim 2 wherein the other coupling member of said second module is provided with an opening to provide access to said fastening means.

4. In a zigzag folding wall construction as defined in claim 1 wherein said panels are pivotally connected to said coupling members by means of strips of synthetic resin material.

5. In a zigzag folding wall construction as defined in claim 2 wherein said panels are pivotally connected to said coupling members by means of strips of synthetic resin material.

6. A zigzag folding wall comprising a plurality of similar modules, each of said modules including first and second coupling members, a first pair of panels having adjacent edges pivotally connected to one another, the opposite edges of said first pair of panels being pivotally connected with said first and second coupling members respectively, each of said modules also including a second pair of panels having adjacent edges pivotally connected to one another, the opposite edges of said second pair of panels being pivotally connected with said first and second coupling members respectively, said panels being foldable in zigzag fashion, a first module having the first coupling member thereof adjacent the second coupling member of a second module, detachable securing means for securing said last-mentioned first and second coupling members to one another to thereby secure the first and second modules to one another, and said second coupling member of said first module having an opening therein aligned with said securing means for receiving a tool therethrough to engage said securing means when assembling or disassembling the wall.

7. A folding wall as defined in claim 6 including a second detachable securing means for securing said first coupling member of said first module to said second coupling member of said second module, said second coupling member of said first module having a second opening therein aligned with said second securing means for receiving a tool therethrough to engage said second securing means when assembling or disassembling the wall.

8. A folding wall as defined in claim 6 including a third module, the first coupling member of said third module being adjacent said second coupling member of said first module, said first coupling member of said third module having an opening therein aligned with said opening in said second coupling member of said first module for receiving a tool therethrough.

9. A folding wall as defined in claim 8 including a second detachable securing means for securing said first coupling member of said first module to said second coupling member of said second module, said second coupling member of said first module having a second opening therein aligned with said second securing means, said first coupling member of said third module having a second opening therein aligned with said second opening in said second coupling member for receiving a tool therethrough to engage said second securing means when assembling or disassembling the wall.

* * * * *